US010471338B2

(12) United States Patent
Gulotty, Jr.

(10) Patent No.: US 10,471,338 B2
(45) Date of Patent: Nov. 12, 2019

(54) WORD FORMING GAME FOR LARGE WORDS

(71) Applicant: Robert J. Gulotty, Jr., Greer, SC (US)

(72) Inventor: Robert J. Gulotty, Jr., Greer, SC (US)

( * ) Notice: Subject to any disclaimer, the term of this patent is extended or adjusted under 35 U.S.C. 154(b) by 0 days.

(21) Appl. No.: 15/854,650

(22) Filed: Dec. 26, 2017

(65) Prior Publication Data

US 2018/0169511 A1 Jun. 21, 2018

Related U.S. Application Data

(63) Continuation-in-part of application No. 15/361,418, filed on Nov. 26, 2016, now abandoned.

(51) Int. Cl.

| | |
|---|---|
| ***A63F 9/24*** | (2006.01) |
| ***A63F 3/04*** | (2006.01) |
| ***A63F 3/00*** | (2006.01) |
| *A63F 1/04* | (2006.01) |

(52) U.S. Cl.

CPC ..... *A63F 3/0423* (2013.01); *A63F 3/00176* (2013.01); *A63F 3/00697* (2013.01); *A63F 2001/0416* (2013.01); *A63F 2003/00182* (2013.01); *A63F 2003/00861* (2013.01); *A63F 2003/00996* (2013.01); *A63F 2003/0426* (2013.01); *A63F 2003/0428* (2013.01)

(58) Field of Classification Search

CPC ..... A63F 3/0423; A63F 9/0098

See application file for complete search history.

(56) References Cited

U.S. PATENT DOCUMENTS

| | | | | | |
|---|---|---|---|---|---|
| 4,055,347 | A * | 10/1977 | Kreischer | A63F 3/0423 | 273/243 |
| 4,306,724 | A * | 12/1981 | Brzezinski | A63F 3/0423 | 273/243 |
| 5,429,371 | A * | 7/1995 | Bledsoe | A63F 3/0423 | 273/243 |
| 6,422,561 | B1 * | 7/2002 | Schroeder | A63F 3/0423 | 273/272 |
| 2006/0022407 | A1 * | 2/2006 | Jensen | A63F 3/04 | 273/272 |
| 2012/0032401 | A1 * | 2/2012 | Loriz | A63F 3/00176 | 273/299 |
| 2013/0231167 | A1 * | 9/2013 | Patnoe | A63F 3/0423 | 463/9 |
| 2014/0327209 | A1 * | 11/2014 | Mizanoski | A63F 3/0423 | 273/272 |
| 2015/0297982 | A1 * | 10/2015 | Ogilvie | A63F 11/00 | 273/148 R |
| 2017/0252639 | A1 * | 9/2017 | Fechser | A63F 3/0423 | |

* cited by examiner

*Primary Examiner* — Steve Rowland
(74) *Attorney, Agent, or Firm* — Southeast IP Group, LLC.; Thomas L. Moses

(57) ABSTRACT

This invention is a novel word forming board game that uses a unique combination of features that enables and rewards large word formation. In addition, chance is used to make the outcome less predictable and more fun for players of all skill levels. The game apparatus includes a larger number of board spaces, a large number of letter tiles, and chance components (multiplier, bonus word, swap card and swap tiles chance types). The method of play uses a large number of letter tiles per player hand, and the ability to exchange letter tiles at the end of each turn. The basis of the word points is the word length which rewards large word formation. The multiplier chance types amplify the impact of forming large words on the player score, with multiplier values as high as 10 and as low as −10, distributed so lesser skilled players can win more often.

10 Claims, No Drawings

WORD FORMING GAME FOR LARGE WORDS

BACKGROUND

Many existing word forming games such as Scrabble® have letter tiles imprinted with the letters of an alphabet such as English, Spanish, etc. Players randomly select up to 7 letter tiles from a pool of 100 tiles and place the tiles on a board to form one or more words. Typically, players must form a word using a letter tile in a previously formed word. Players may replenish the number of letters previously used to form a word by drawing the same number of letter tiles from the pool of letter tiles at the end of each turn.

The quantity of each vowel or consonant in the pool of letter tiles usually reflects the relative frequency of use of each of the letters in the words of the language. Typically, the number of points assigned to each tile is related to the scarcity of the letter, with common letters such as the letter E being worth 1 point, and less common letters such as Z being worth 10 points. In this invention, there are no numbers on the letter tiles used to form words. The point value of each letter is one point. The number of points awarded for playing a word related to the sum of the letter values for the letters in the word. In addition, the points accrued for each letter in the word may be doubled or tripled by placement of the letter on a "Premium space" on the board which doubles or triples the points based on the value of the letter. In Scrabble®, the number of letter tiles a player may use to make a word in a given turn is limited to seven new tiles. It is often challenging to make a word from these few tiles. In addition, much of the strategy is based on the placement of high value letter tiles on "Premium spaces." In this invention, there are no premium spaces on the game board, the spaces are blank. The point value of the word or words formed on the board is simply the sum of number of letter tiles in the new word or words formed.

Although it is possible in games such as Scrabble® to add the seven new tiles to an existing word on the board to make a larger word, it is generally less common and difficult to make large words. Short words such as Qi or Za are often used to make the most points in a player turn. By placing these words on Premium spaces, and preferably adjacent to an "I" or "a" on the board such that the letter Q or Z forms triple word scores in two directions. Often players with better word forming skills are frustrated by Scrabble® and similar word games, as the placement strategies often win over better word forming skills. In this invention, all letter tiles have only a letter or blank. The point value of each letter is one point, in contrast to previous art. In addition, each board space is a blank space where one letter can be added. There are no spaces which have the attribute of multiplying the value of the letter or word as in previous art. In addition, in this invention, a larger pool of letters is used. These three aspects of the game apparatus of this invention change the method of game play to one with an emphasis of the formation of large words instead of an emphasis on the points of a letter in the word and the position of the letter on spaces that multiply the letter point value. In addition, in the methods of this invention, a larger number of letter tiles is available for use in each players hand for each turn so that the player can have a higher probability of having the letters needed to form larger words during their turn. Also, in this invention, at the end of each turn, players may exchange unused letter tiles for new ones from the letter tile pool to improve their ability to make large words in their next turn. When taken in combination, the three new features of the game apparatus and two new features in the method of play make five features that differentiate this invention from previous art. On the other hand, those with weaker word forming skills are also frustrated by those with better word forming skills as they consistently lose to the better player and have little chance of winning. In this invention, chance is added so that the probability that a player with weaker word forming skill can win is greater and the player with the better word forming skill, although still more likely to win, will have a lower probability of winning than without chance added to the game. Hence this invention makes the game outcome less predictable and players of different skill levels will be more likely to enjoy playing the game together.

The object of this invention is to make a word forming game that is more enjoyable to both those with high word forming skills and to those with less word forming skills. Further it is an aim of this invention to have a game which allows the players to improve their word forming skills, particularly for larger words. Third, it is an object of this invention to make the game outcome less certain, such that players with lesser word forming skills have a greater chance to win the game than in previous game-forming games. These objectives are achieved by employing particular combinations of game apparatus and methods of play in unique ways. The word forming game of this invention is novel and substantially different from Scrabble® and other word forming games.

FIELD OF THE INVENTION

The field of the present invention relates to games and more specifically to word forming games.

DESCRIPTION OF RELATED ART

Brunot et al. (U.S. Pat. No. 2,752,158) disclosed a patent which is related to the popular Scrabble® game, specifically the use of Premium spaces that double or triple the value of the letters in the word. The invention of Brunot differs from this invention, there are no Premium spaces on the game board of this invention, and there are no values associated with each letter other than 1 point per letter. In this invention there are more letters in the players hand, a greater number of spaces on the board, and the option to exchange of letters after each turn, all of which make large word formation easier than in Brunot. In addition, particular embodiments of this invention uses a second novel aspect whereby numerical multipliers made available to the players by chance, called "multiplier chance typers."The multiplier chance types are number values that modify the score achieved for a word by multiplying the word length (number of letters in the word or words played) by the numerical value of the multiplier chance type. The numerical values of the multiplier chance types are comprised of whole number with values between−10 and +10. The multiplier chance types are used to amplify the benefit of large word formation. A Third novel aspect in one embodiment of this invention is the addition of multiple chance cards to the players hand which can be used in each turn. This allows the player to manage when the chance cards are played. This novel aspect enables the player to use more strategy to maximize their word score.

Marsoni et al. (U.S. Pat. No. 4,055,348) discloses the use of a chance device to display letters in a word game, where two displayed letters are then used by game participants to make a word. Wakefield (U.S. Pat. No. 5,769,421) discloses using a six-sided die in combination with a four-section board to select letters which players use to form words. While chance is used to select letters that are used for word creation in Marsoni and Wakefield, this invention differs in that the chance is used after the word creation process to make a game where chance modifies the outcome. These two prior art examples use chance to make the word formation process more difficult, in contrast, this invention gives the players larger numbers of letters to make words, and a large number of board spaces, making the formation of large words easier for players.

Brzezinski et al. (U.S. Pat. No. 4,306,724), Jensen et al. (US20060022407) and Patnoe et al. (US20130231167 A1) build on the same basic word-game apparatus and method of Scrabble® that relies on score multipliers determined by the position of the letter on the board, and letter values that have different point values associated with them. The word score for a players turn in this invention does not rely on the position of the word on Premium board spaces, nor does the score depend on the type of letter played. The player score in this invention is based on the word length, the number of letters in the word or words played by the player during their turn.

Although Brzezinski does combine word forming and elements of chance, there are few elements of similarity or combinations of elements of similarity of the Brzezinski art and the art of this invention. Brzezinski employs the use of a second game board involving the movement of game pieces as in Monopoly® including "certificates, similar to Monopoly® money, there are 31 letters per hand which are not replenished, the "Bonus card" is not a "bonus word card" as it is in this invention, and word categories restrict the type of words formed. In addition, in Brzezinski there are multiple chance control features, dice, wheels, spinners used together in game play. Players buy letter pieces by paying the point value of each letter piece in terms of the point certificate values from the bank, similar to Monopoly®. Distinctly, in this invention there are 12 to 16, and preferably 16 letter tiles per hand, which are replenished at the end of each turn and remaining letter tiles are optionally swapped at the end of each turn.

Jensen discloses a crossword puzzle game where players are rewarded points for guessing the correct word based on clues. A cubical die is used to define whether a player will try to guess a word "down" or "across" as is the custom in crossword puzzle games. While there is no definition of the assignment of points in the claims in Jensen, the specification suggests that points are awarded according to the number of clues needed to solve for the word. When words are solved in "one clue answer may be allotted thirty points," "twenty points for the two clue answers," and "three of more clue answers may be allotted points in increments of 5 points." There is no word-forming of the type of this invention where the word formed is created from letters in the players hand. In addition, there is no consideration of word length in the assignment of points for a guessed word. In Jensen, points are assigned based on whether one, two or three or more clues are used to correctly identify the word in the puzzle that fits the space on the board being played. Jensen does not teach this invention.

Patnoe discloses a word-forming game in which, "point values are assigned to letters based on the estimated difficulty of using the letter to form a word," and "if a (letter) tile located on a bonus square (board space) . . . for example, one such bonus could a "Double Word Score" bonus, which doubles the points earned for the word. This disclosure is similar to the method of play in Scrabble® and does not teach this invention.

The game play of Patnoe also includes additional possible assignment of points that has nothing to do with the word length played in the turn, e.g. subtracting points or adding points or multiplying or dividing the players total score in the game by a number when that type of "bonus" is associated with the board space occupied by the word played.

Patnoe also uses the term "Bonus word" as "any word that the game client provides a bonus for when a player spells out the word using the tiles on the game board." This is not the meaning of this invention, where the player gets to play an extra word during their turn using the letter tiles remaining in their hand.

Patnoe claims "a point multiplier action modifying any points earned by the player on the current turn." While this broad statement does involve the concept of a multiplier, as does Scrabble® with the "Premium board spaces" that either multiply a letter in the word, or the word by 2 times (Double letter score or Double word score), or 3 times (Triple letter score for Triple word score). Patnoe does not specify multipliers as implemented in this invention, where the word score is based on word length (the number of letters in the word or words played) and is the mathematical product of the word length and the value of multiplier chance types comprised of whole number values of −10 to +10.

Patnoe discloses traps that can be assigned to board spaces, which results in a zero score for the player in that turn. The Patnoe trap does not teach a Bankrupt card as practiced in one embodiment (i.e. "Original" game example) of this invention, where a Bankrupt card is added to the card deck for a game played by 3 or more players. In this invention, the bankrupt card is randomly drawn from a card deck and makes the players total score up until that point in the game set to zero.

Ogilvie et al. (US2015029782 A1) discloses enhancements of familiar games by modification of equipment or rule changes. In the case of Scrabble®, Ogilvie suggests simple changes to the game play such as "allowing a player to have up to nine Scrabble® tiles." Or more broadly, "examples of values that may change include the maximum number of Scrabble® tiles." In addition, Ogilvie proposes much different modifications of play than in this invention, e.g. "During the Scrabble® game" or "Now": "Draw 3 tiles instead of 1, then put 2 back", "You are only allowed 6 tiles at a time. Return any extras; You choose which ones.", "Draw 4 tiles instead of 1, then put 3 back.", "You are allowed 8 tiles at a time. Draw any extras now.", "Double your score for this turn.", "Remove any word from the Board. Score does not change. Tiles go to the draw pile.", "Turn 3 draw pile tiles face up. They stay that way after your turn.", "Remove any 2 words from the Board. Score does not change. Tiles go to the draw pile.", "Place a word anywhere on the Board. Even if it does not connect with any other word."

Ogilvie discloses the concept of a "Full Swap," defined as "Swap all items with the team on your left . . . or right." This concept of swapping was not applied as in this invention, where strategic parts of the game apparatus, such as chance cards are exchanged for new cards from the card deck when the swap cards chance type is played or when letter tiles are swapped with a player to the left when a swap tiles chance type is played.

Ogilvie also discloses the word "bankrupt," in conjunction with Beiinx game card pack enhancement of a Monopoly® type game, where the bank takes 3 houses from the player when they draw a "bankrupt" card. Ogilvie also does not have the word "bonus" in his disclosure, so there is not a disclosure of "bonus words."

None of the above inventions and patents, taken either singly or in combination, is seen to describe the instant invention as claimed. Thus a word-forming game solving the aforementioned problems is desired.

SUMMARY

The present invention overcomes these and other limitations of known word forming games by providing particular combinations of game apparatus and methods of play which make it easier for players to make large words and the game outcome is related to the formation of large words. A game apparatus with a larger pool of letter tiles and a larger number of spaces on the game board and methods of play which employs a larger number of letters in the players hands and the exchange of less useful letter tiles after each turn, facilitates large word formation and greater enjoyment of the game. Uniquely, the sole basis of the score for a word or words played is the number of letter tiles played in the word or words formed during the turn. In addition, the basis of the score is amplified by multiplier chance types drawn randomly, which multiply the points earned for the played word or words by positive, negative and zero valued whole numbers. The high value of these multipliers and the distribution of the values for these multipliers is chosen to level the playing field while still having the most skilled players win more often. Other chance types, when in the form of chance cards, include one or more of Bonus word, Swap Cards, Swap Tiles, and Bankrupt. These chance types add complexity to the game and enable more strategy to be used. In one embodiment, the method of play includes chance types in the form of chance cards and the players draw chance cards from a card deck after playing a word on the board. In a second embodiment, the chance types are in the form of chance cards and 5 to 7 chance cards are drawn from the card deck and held in the players hand for use in each turn. The cards played during the turn are replenished at the end of the turn. The addition of 5 to 7 chance cards to the players hand enables the player to use more strategy to maximize their word score. In a third embodiment, chance cards are not used and the game outcome is solely determined from the number of letters in words played by each player during the game. This embodiment is for the word forming game enthusiast who only wants a game based on forming large words using the other features of this invention. The game features of this invention result in enhanced ability to make large words and more emphasis on points awarded for large words. In addition, chance types have been added which can be used to have a less predictable game outcome, making the game challenging and fun for more people.

DETAILED DESCRIPTION OF THE INVENTION

The Game Apparatus and Embodiments

The game apparatus common to the three embodiments of this invention comprises:

a. a pool of 150 to 300 letter tiles including the alphabet of the English or other language and one or more blank tiles, and preferably 216 letter tiles, b. a game board containing 650 to 841 board spaces which allow the placement of letter tiles to form words of one or more letter tiles and preferably 676 tiles.

Two of the three embodiments also comprise:

c. a deck of cards of 50-54 cards that contains chance types, d. chance types which include one or more of bonus word, swap tiles, swap cards, and multiplier cards, e. multiplier cards which include positive, zero, and negative value cards with values of −10 to 10.

The apparatus can be either a physical based or virtual game. The game may be played on various media, including but not limited to, physical media, electronic game consoles, computers, and interactive and social media networks accessed using computers, cellular devices, tablets, etc.

In each of the three embodiments of this invention a method of play uses the apparatus above to:

a. have players selecting 12 to 16 letter tiles in their hand in each turn from which they form a word.

b. players placing one or more of the letter tiles on the game board in the available board spaces to create a word on the board (once one word is on the board, new words must be build off of an existing word on the board), c. The player exchanges less desirable letter tiles and replenishes letter tiles that were used to make word(s) at the end of the turn.

In two of the three embodiments of this invention, the method of play also uses chance types including number multiplier cards, and one or more of bonus word, swap cards, and bankrupt chance types. When a player chooses to play a bonus word card, then can form and additional word on the board using the remaining letters in their hand. A "swap cards" allows the player to exchange one or more of the cards in their hand for the same number of cards from the card deck. This card can only be played at the beginning or end of the hand, before forming a word or after all word forming is done for the players turn.

The method of game ending is chosen from standard methods known to those skilled in the art, such as, completing a number of turns for each player, achieving total score, playing for a set amount of time, playing until the letter tile pool is empty or until the first player had played all of the letters in their hand and no letters are left in the letter tile pool.

The apparatus of this invention, can use chance types in the form of playing cards, spinners, dice, of other game components known to those skilled in the art.

The words are formed according to customs of the language of the game, which for the English language is horizontally (left to right) and vertically (top to bottom). Further details of the three embodiments are given in the examples below.

Example 1. Apparatus

The following items are an example of an apparatus as a working example of this invention:

1. A square game board comprised of 676 spaces, 26 spaces wide by 26 spaces high.

2. Two hundred sixteen letter tiles comprised of the following distribution of letter tiles: A-17, B-4, C-5, D-9, E-24, F-4, G-6, H-5, I-18, J-2, K-2, L-8, M-5, N-13, O-17, P-4, Q-2, R-14, S-11, T-14, U-8, V-4, W-5, X-2, Y-5, Z-2, blank-6.

3. Fifty chance type cards comprised of the following distribution of card types (chance type, number of that type): Bonus word, 6 each; Swap cards, 4 each, Multiplier cards (value and number of cards): ×0 multiplier, 3 each; ×1 multiplier, 5 each; ×2 multiplier, 5 each; ×3 multiplier, 5 each; ×4 multiplier, 4 each; ×5 multiplier, 4 each; ×6 multiplier, 4 each; ×7 multiplier, 4 each; ×8 multiplier, 1 each; ×9 multiplier, 1 each; ×10 multiplier, 1 each; ×−5 multiplier, 2 each; ×−10 multiplier, 1 each.

4. In one embodiment (e.g. example 2 below), 2 additional Swap tiles cards are used.

Example 2. Method of Play in the First Embodiment—"Original" Game Version

The following steps are an example of the method of play as taught in this invention. The Apparatus in Example 1 was used for this example. There are four players in this example game. The method of play in this example consists of the following steps:

1. The players decide that they will play the game until the letter tile pool is empty and one player has played all of their tiles.
2. Each player selects one tile from the letter tile pool. The person with the highest letter of the alphabet earned to right to play first.
3. Each player selects 16 letter tiles from the letter tile pool starting with the first player and then the next player to the left of the first player.
4. The card deck is shuffled to randomize the cards in the deck.
5. The first player places 8 letter tiles on the board to form a word.
6. The first player then draws a chance type card from the card deck, it is a multiplier card with value of 3.
7. The first player records a score of 24 for their turn based on a product of the number of letter tiles in the word (8) and the number of the multiplier card (3).
8. The first player exchanges 2 of the 8 letter tiles that they did not play in the hand to improve the ability to play a word in their next turn.
9. The first player then also replenishes the 8 letter tiles from the letter tile pool for their next play.
10. The second player plays a word using one of the letters from the word on the board and an additional 6 new letters from the 16 letter tiles in their hand.
11. The second player draws a "bonus word" card. They decide to play the card in this turn and form a second word of length 5 letters. This brings the total number of letter tiles they played during this turn to 12.
12. The second player then draws a multiplier card with a value of 7.
13. The second player records a score of 84 based on a product of the number of letter tiles in the words formed during their hand (5+7=12) and the value of the multiplier card (7).
14. The second player decides to exchange three of the remaining tiles in their hand and replenishes the 10 letter tiles from the letter tile pool for their next turn.
15. The third player plays a word of length 7 letter tiles. They draw a "swap cards" card. They place this card face up on the game surface for use later. They then draw a number card of −10. They decide to use the swap cards card in this turn, and discard the −10 card and select another card. The card is a number 7 card. The players score is 49 for the turn (7×7). The player has avoided a score of −70 for the turn by playing the swap cards card.
16. The third player decides to exchange none of the remaining tiles in their hand and replenishes the 6 letter tiles that were used to form the word played from the letter tile pool for their next turn.
17. The fourth player plays a 9 letter word on the board and then draws a "bankrupt" card. The players score for the turn, and their total score are adjusted to zero.
18. Player 4 exchanges 3 letter tiles to improve their hand for the next turn and replenishes the 8 letters that were used to form the word played.
19. Player 1 plays a 6 letter word on the board and then draws a "swap tiles" card. Each player now exchanges tiles with the player to their left. The player to the left of player 1 replenishes the 5 tiles used by player 1 to form the word before their next turn. Player 1 then draws another card, it is a multiplier card with value 3. The score for Player 1 for the turn is 18 (6×3=18).
20. The players continue taking turns until the tile pool was empty and the third player has no tiles left.
21. The third players total score is the sum of the scores for each turn played.
22. Player 1 has 8 tiles remaining in their hand, they draw a number card of value 3. They calculate the product of the 8 tiles and the number card 3, which is 24 and subtract 24 points from the total score they accumulated during their turns.
23. Player 2 has 5 tiles left. They draw a −5 number card. They calculate the product of the 5 tiles and −5 number card, which is −25. They subtract −25 from their score, which adds 25 points to their total score.
24. Player 4 had 11 tiles left. They drew a number 0 card, so the product they calculate was 0 and no points were subtracted from their total score.
25. Player 3 had the highest number total score and won the game.

Example 3. Method of Play in the Second Embodiment—"Gamer" Game Version

The following steps are an example of the method of play as taught in this invention. The Apparatus in Example 1 was used for this example. There are four players in this example game. The method of play in this example consists of the following steps:

1. The players decide to choose a game ending of 500 total points.
2. Steps 2-4 of Example 3 are repeated here.
3. Each player selects 5 chance cards from the card deck.
4. The first player places 8 letter tiles on the board to form a word.
5. The first player then plays a multiplier card from their hand with number value 3.
6. The first player records a score of 24 based on a product of the number of letter tiles in the word (8) and the number of the multiplier card (3).
7. The first player exchanges 2 of the 8 letter tiles that they did not play in the hand to improve the ability to play a word in their next turn.
8. The first player replenishes the 8 letter tiles from the letter tile pool and chance cards from the card deck for their next play.
9. The second player plays a word using one of the letters from the word on the board and an additional 6 new letters from the 16 letter tiles in their hand.
10. The second player then decides to play a bonus word card from their hand and form a second word of length 5 letters.
11. The second player then plays a multiplier card from their hand with a value of 7.
12. The second player records a score of 84 based on a product of the number of letter tiles in the words formed (5+7=12) and the number of the multiplier card (7).
13. The second player decides to exchange three of the remaining tiles in their hand and replenishes the 6 letter tiles from the letter tile pool and also replenishes the chance cards used during this hand from the card deck for their next play.

14. It is the third players turn and they note that the highest number value multiplier card in their hand is 2 and there are other low number cards in their hand (−5 and 0). The player uses their swap cards card to discard the low number cards and replace them with new cards from the card deck.

15. The third player plays a word of length 7 letter tiles.

16. The third player now plays a number 6 multiplier card.

17. The third players score is 42 for the turn (7×6).

18. The third player decides to exchange none of the remaining tiles in their hand and replenishes the 6 letter tiles played to form the word played from the letter tile pool and also replenishes the chance cards from the card deck for their next turn.

19. The four players continue taking turns until player 2 reached a score of 500 points.

20. Player 3 and 4 each play one more turn to match the number of turns played by player 2.

21. Player 2 had the highest total score and won the game.

Example 4. Method of Play in the Third Embodiment-"Wordy" Game Version

The following steps are an example of the method of play as taught in this invention. The Apparatus in Example 1 was used for this example. There are two players in this example game. The method of play in this example consists of the following steps:

1. The players choose a method of game ending of playing to 100 points.

2. Steps 2-3 of Example 3 are repeated here.

3. The first player plays a word with 8 letters, and records a score of 8, the sum of the letters in the word. In this embodiment, chance cards are not used.

4. The first player exchanges 2 of the 8 letter tiles that they did not play in the hand to improve the ability to play a word in their next turn.

5. The first player then also replenishes the 8 letter tiles from the letter tile pool for their next play.

6. The second player plays a word using one of the letters from the word on the board and an additional 6 new letters from the 16 letter tiles in their hand.

8. The players score is 7, the sum of the letters played in the word formed.

9. Player 1 and 2 take turns as above until player 2 reached 100 points. Since player one already had their turn for that round of play, the game is over.

10. Player 2 won the game as they had the most points.

What is claimed is:

1. A method of playing a word forming game among a group of participants, said method comprising the steps of:

providing a pool of 150 to 300 letter tiles including a combination of alphabetical letters and blank tiles;

providing a game board having between 650 and 841 board spaces for placement of said letter tiles to form words of one or more said letter tiles;

providing a deck of between 50 to 54 cards that contain chance types selected from the group consisting of bonus word, bankrupt cards, swap cards, swap tiles, multiplier cards, and any combination thereof;

including positive, zero and negative value cards having values from −10 to 10;

each participant selecting from 12 to 16 letter tiles from said pool of letter tiles for forming words;

each participant taking a turn, wherein a turn includes the steps of:

a) placing one or more of said selected letter tiles on said game board in available board spaces to create a word on said board b) selecting a chance card and following instructions on said selected chance card; and c) calculating a score for said participant's turn;

allowing each participant to take said turns until said game is over;

adding each participant's cumulative scores from each of that participant's turns; and comparing scores of each participant to determine a winner of said game.

2. The method of playing a word forming game set forth in claim 1, wherein said multiplier cards include numerical values selected from the group consisting of −10, −5, 0, 1, 2, 3, 4, 5, 6, 7, 8, 9, and 10.

3. The method of playing a word forming game set forth in claim 1, wherein following said chance card instructions for bonus word includes playing an additional word from remaining letter tiles or saving said bonus word chance card for use in another turn.

4. The method of playing a word forming game set forth in claim 1, wherein following said chance card instructions for swap card includes swapping said swap card chance card with a chance card held by another participant or saving said swap card chance card for use in another turn.

5. The method of playing a word forming game set forth in claim 1, wherein following said chance card instructions for multiplier card includes calculating and recording points for said participants turn as a product of the number of letters in a word played and a number value of said multiplier chance card.

6. The method of playing a word forming game set forth in claim 1, wherein following said chance card instructions for bankrupt card includes recording a zero score for that participant's turn, and recording that participant's total cumulative score to zero.

7. The method of playing a word forming game set forth in claim 1, further including the step of:

distributing five chance cards to each participant before any participant has taken a first turn.

8. The method of playing a word forming game set forth in claim 1, further including the step of:

allowing each participant to discard one of its cards prior to placing said letter tiles on said board for forming a word.

9. The method of playing a word forming game set forth in claim 1, further including the step of allowing participants to exchange any remaining letter tiles for new letter tiles after said participant has placed letter tiles on said board forming a word.

10. The method of playing a word forming game set forth in claim 1, further including the step of:

allowing each participant to replenish a number of letter tiles that said participant used in forming said word on said board by selecting new letter tiles from said pool of letter tiles.

* * * * *